United States Patent [19]

Lowndes, III

[11] Patent Number: 4,724,649

[45] Date of Patent: Feb. 16, 1988

[54] SIDE WELD PLATE FOR CONCRETE SLABS

[75] Inventor: William Lowndes, III, Spartanburg, S.C.

[73] Assignee: Lowndes Corporation, Greenville, S.C.

[21] Appl. No.: 887,519

[22] Filed: Jul. 21, 1986

[51] Int. Cl.[4] ..... E04B 1/21; E04C 2/04

[52] U.S. Cl. ..... 52/583; 52/601

[58] Field of Search ..... 52/378, 583, 562, 601

[56] References Cited

U.S. PATENT DOCUMENTS

| | | | |
|---|---|---|---|
| 760,999 | 5/1904 | Landis | 52/601 |
| 940,326 | 11/1909 | Kaspar | 52/378 |
| 1,399,088 | 12/1921 | Seymour | 52/601 |
| 2,091,061 | 8/1937 | Waugh | 52/601 |
| 2,462,415 | 2/1949 | Nagel | 52/583 |
| 2,755,484 | 7/1956 | Hotz | 52/378 |
| 3,958,954 | 5/1976 | Ehlenbeck | 52/583 |
| 4,182,092 | 1/1980 | Weaver | 52/583 |

FOREIGN PATENT DOCUMENTS

| | | | |
|---|---|---|---|
| 543852 | 7/1957 | Canada | 52/378 |
| 2843889 | 4/1980 | Fed. Rep. of Germany | 52/601 |
| 1170977 | 1/1959 | France | 52/378 |
| 606868 | 7/1960 | Italy | 52/601 |
| 330735 | 6/1958 | Switzerland | 52/583 |

*Primary Examiner*—William F. Pate, III
*Assistant Examiner*—Michael Safavi
*Attorney, Agent, or Firm*—Dority & Manning

[57] ABSTRACT

A side weld plate for joining adjacent concrete slabs together by welding. An elongated body is provided having a body section for embedment in a concrete slab and a flange section for positioning adjacent an edge of the concrete slab. The flange surface provides upon embedment of the body section in the concrete slab, an exposed weld surface which allows for adjacent concrete slabs also having a side weld plate to be welded together.

10 Claims, 7 Drawing Figures

SIDE WELD PLATE FOR CONCRETE SLABS

BACKGROUND OF THE INVENTION

The present invention relates to an improved side weld plate for allowing adjacent concrete slabs to be welded to one another.

Prestressed concrete slabs are widely used throughout the building industry. They are typically used in flooring and roofing applications. The slabs are generally rectangular in shape and are placed side-by-side, edge-to-edge when used in flooring and roofing applications to form a continuous concrete planar surface.

Fixing of the slabs in place is normally accomplished by welding together side weld plates, which extend along the edges of the slabs. The welding together of the side weld plates of adjacent slabs allows the slabs to provide a very strong flooring or roofing structure.

Typically, a side weld plate assembly includes a side weld plate which is attached to rods, or reinforcement bars. The rods of the plate are embedded in a concrete slab when the slab is cast, extending substantially parallel to the planar surface of the slab in which they are embedded. The weld plate to which the rods are secured is located at an edge of the slab, where the plate is exposed for attachment by welding or some other suitable means to an adjacent weld plate, a metal bar received between the weld plates or the like. Because the weld characteristics, strength characteristics, and general quality characteristics of the rods or bars vary significantly from shipment to shipment, problems arise in establishing a consistent procedure for providing the concrete slabs with uniform side weld plate assemblies.

Another problem exists with the typical side weld plate assembly, in that, the ability of the joined slabs to withstand vertical loads depends significantly on the quality of the reinforcing rods or bars or the weldment at the bar-plate junction. Still another problem exists with the typical side weld plate assembly in that the side weld plate, when connected to the ends of the rods or bars, can become misaligned and actually project above the planar surface of the concrete slab, thereby possibly damaging roofing or flooring material later installed on the slab, decreasing slab strength, or the like.

Various types of side plate assemblies have been patented. U.S. Pat. No. 3,958,954, granted to Ehlenbeck, discloses an integral side weld plate assembly for embedment into a concrete slab having a central portion adjacent the side weld plate which remains exposed after the side weld plate has been welded. U.S. Pat. No. 2,462,415, granted to Nagel, discloses a side weld assembly having a peripheral portion formed from sheet metal with channels extending to a slab. The channels are adapted to receive reinforcing bars.

SUMMARY OF THE INVENTION

It is an object of the present invention to provide an improved side weld plate for use in conjunction with concrete slabs.

Another object of the present invention is to provide an improved side weld plate for allowing adjacent concrete slabs to be welded to one another.

Still another object of the present invention is to provide a side weld plate for allowing adjacent concrete slabs to be attached to one another which reduces the likelihood of misalignment between the side weld plate and the planar surface of a slab.

Yet another object of the present invention is to provide a side weld plate for allowing adjacent concrete slabs to be attached to one another which has readily controllable material characteristics.

Generally, the present invention includes an attachment element for embedment into a concrete body, the attachment element providing an attachment interface for allowing the concrete body to be joined at an edge thereof to an edge of an adjacent surface, the attachment element comprising an elongated body member; a body section defined in the elongated body member for embedment within a concrete body; and a flange section defined in the elongated body member integral with and adjacent said body section, said flange section extending upwardly from said body section at a predetermined angle relative to said body section so that upon embedment of said body section into the concrete body, said flange section extends adjacent an edge of the concrete body to provide the attachment interface for joining the concrete body to said adjacent surface.

In a preferred embodiment of the present invention, both the body section and the flange section are generally rectangular in shape, the body section being significantly larger in size than the flange section. A concrete receiving void is defined by the body section to better secure the attachment element within the concrete slab.

BRIEF DESCRIPTION OF THE DRAWINGS

The foregoing as well as other objects of the present invention will be more apparent from the following detailed description of the preferred embodiment of the invention, when taken together with the accompanying drawings, in which.

DESCRIPTION OF THE INVENTION

Figure 2:
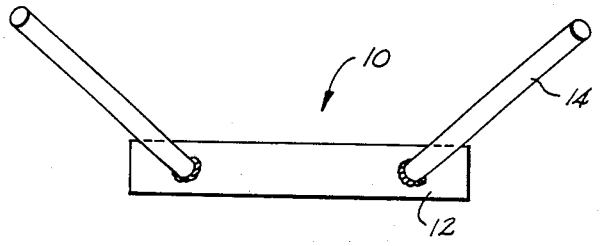
Fig. 2 (PRIOR ART)
FIG. 2 is a perspective view of a prior art side weld plate assembly.
Figure 3:
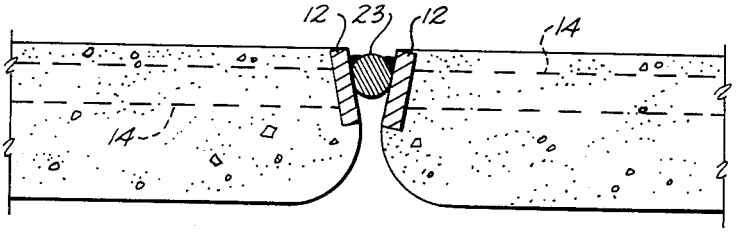
Fig. 3 (PRIOR ART)
FIG. 3 is a sectional view of a prior art side weld plate assembly as embedded in slabs and illustrating connection of two such slabs.

Referring to the drawings, a prior art weld plate assembly 10 of the type described above, is illustrated in FIGS. 2 and 3. Prior art side weld plate assembly 10 includes a side weld flange 12 with embedment rods or bars 14 welded thereto. Embedment bars 14 are embedded in a concrete slab during formation by forcing the bars 14 into the green concrete after pouring so that the weld flange 12 extends along an edge of the formed slab. Weld flange 12 thus provides a weld surface for welding the slab to a weld flange of an adjacent slab, preferably by a round bar 23 welded across the joint between the slabs.

Figure 1:
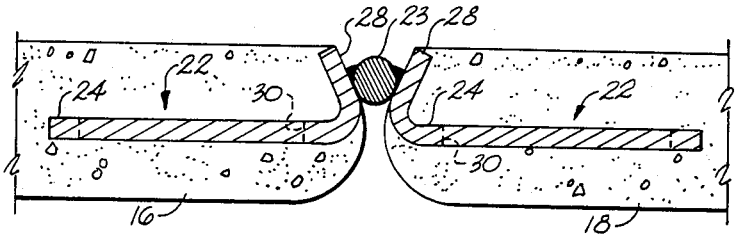
FIG. 1 is a sectional view of a preferred form of side weld plate assemblies constructed in accordance with the present invention embedded in two adjacent concret slabs, and illustrating connection of the two slabs.
Figure 4:
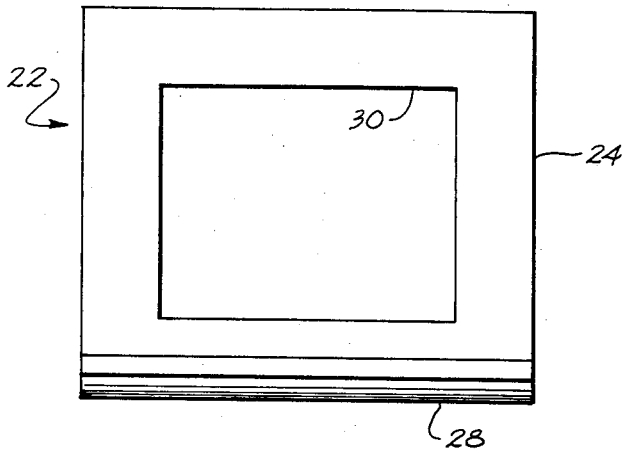
FIG. 4 is a top plan view of a preferred form of a side weld plate constructed in accordance with the present invention.
Figure 4A:
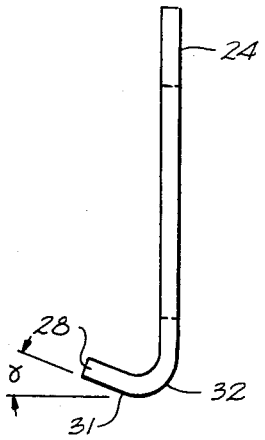
FIG. 4*a* is a side view of the side weld plate shown in FIG. 4.

Referring now to FIGS. 1, 4 and 4*a*, two adjacent concrete slabs 16, 18 are illustrated as secured when using side weld plates of the present invention, designated generally as 22. A bar or slug 23 is placed between the opposite side weld plates 22 after concrete slabs 16, 18 are located adjacent one another. Bar 23 is welded in place to both side weld plates 22 thus uniting concrete slabs 16, 18. Side weld plate 22 includes an elongated body section 24 and a flange section 28 that is secured thereto and extends upwardly therefrom. Weld plate 22 is preferably formed from A-36 sheet or plate steel, although any other suitable steel or other material could also be used.

Body section 24, preferably rectangular in shape, is the portion of weld plate 22 which is actually embedded within a concrete slab during manufacture of the slab. A concrete receiving void or opening 30 is defined by body section 24 to better secure body section 24 within the concrete slab. Particularly, with body section 24 positioned in the cementitious composition before setting, cement passes through opening 30 and sets as a monolithic structure above, below and through the thickness of body section 24.

Flange section 28 is formed in weld plate 22 adjacent body section 24, and extends angularly upwardly therefrom, preferably at an acute angle with respect to body section 24. Most preferably, flange section 28 is arranged with respect to body section 24 to provide an angle $\alpha$ in a range of from about 20 to 35 degrees from a plane perpendicular to body section 24. Body section 24 of weld plate 22 is thus embedded in a concrete slab to locate flange section 28 substantially flush with an edge of the slab 22 to provide an exposed surface 31 to which a bar 23, another flange section surface 28 of an adjacent concrete slab, or some other surface such as a fixed metal anchoring means can be welded. A curved transitional bend 32 is normally provided on weld plate 22 at the junction between body section 24 and flange section 28.

Figure 5:
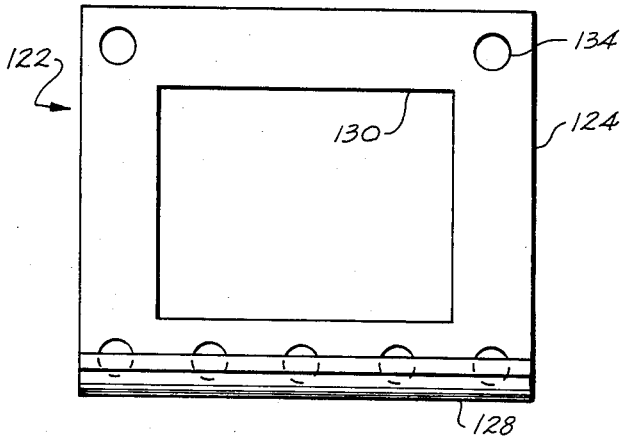
FIG. 5 is a top view of a further embodiment of a side weld plate constructed in accordance with the present invention.
Figure 5A:
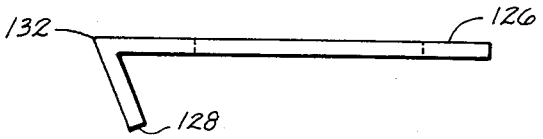
FIG. 5*a* is a side view of the side weld plate shown in FIG. 5.

Referring now to FIG. 5, a further embodiment of a side weld plate of the present invention is designated generally as 122. Side weld plate 122 includes an elongated body section 124 and a flange section 128.

Body section 124 defines a concrete receiving opening or void 130 as well as a further plurality of concrete receiving openings 134 located about opening 130 to further assist in firmly securing side weld body section 124 within a concrete slab.

Flange section 128 extends upwardly from body section 124 at an acute angle with respect thereto of the same general range as specified with respect to weld plate 22. A substantially sharp transition bend 132 exists between body section 126 and flange section 128, though such bend could be curved as shown for weld plate 22.

Side weld plate 22 and side weld plate 122 are utilized in substantially the same manner. During casting of a concrete slab, the body section of the side weld plate is properly located within the slab casting apparatus and may be held in place by tying to wire mesh reinforcement located in the casting apparatus. The body section 24 or 124 becomes embedded in the formed slab with concrete completely thereabout and with the flange surface 28 or 128 substantially at the edge of the slab, generally coterminus with remaining edge portions of the slab. Upon setting of the concrete, the side plate is thus rigidly and permanently fixed to the concrete slab. Obviously, dimensions of concrete slabs with which weld plates of the present invention may be used can vary considerably. One generally suitable slab is a double tee slab having a width of about 10 feet and a length of from about 60 to about 80 feet and a slab thickness of about two inches. With such slab dimensions, one can readily see the need for accurate location of the weld plate, for only slight deviation (about one inch) will result in exposure of the portion of the plate embedded in the slab. Such points to the need for the present invention. Further, with a two inch slab thickness, body sections 24, 124 of the embodiments illustrated herein are planar in nature.

Side weld plates according to the present invention may be easily mass produced with better consistence and quality than the prior art weld plates. For example, side weld plates according to the present invention may be formed from flat stock of a desired material. The flat stock may be die cut, punched, or otherwise processed to produce the appropriate openings therein, after which the plate may be bent to form the body and flange sections, with a predetermined angular relationship as desired. Such manufacturing techniques also represent significant economy over prior art plates due to greatly reduced fabrication labor. Moreover, while FIGS. 4 and 5 illustrate particular size and shaped openings, obviously same may be varied as to size, shape, number and location as dictated by the needs of a particular weld plate being produced. Likewise, while the body and flange sections of the weld plate embodiments illustrated herein are shown to have flat or planar surfaces somewhat dictated by slab thickness, both body and flange sections could include other than flat surfaces. As such, for slabs or other concrete bodies having adequate thickness, one or both sections could present an undulating, corrugated or other non-flat surface, such as a surface which included outwardly extending tabs, which could improve strength of same against horizontal forces thereon.

The side weld plate of the present invention is not only suitable for joining concrete slabs together, but may also be used to join together concrete bodies of other shapes. Also, and quite importantly, the side weld plates of the present invention are nestable when stacked upon one another to aid in transit and storage thereof.

Because side weld plates of the present invention do not require preparatory welding to rods or bars for proper embedding and/or securement to the concrete slab, a more uniform weld plate is achievable. Consequently, the ability to properly embed a weld plate and have a welding surface properly disposed along the edge of the slab is fostered. Particularly, during formation of the concrete slab, due to the presence of a body surface that generally spans the width of the plate as opposed to a plurality of separate rods, there is much less tendency for canting or other misalignment of the weld plate prior to setting of the concrete. The result is a more uniform slab. Greater ability to carry vertical loads is also attributed to the fact that the body section of the plate embedded in the concrete offers a significantly higher resistance to break out from the slab than the pair of bars of prior art plates.

Quite importantly, elimination of the weldments of prior art side weld plates at the plate-reinforcing bar junction improves the ability of joined concrete slabs to withstand vertical loads, and also reduces the likelihood of misalignment between the side weld plate and a surface of the concrete slab. Anchorage of the plate of the present invention is enhanced over prior art plates, since with the present plate, steel bears on concrete while with prior plates, anchorage depended on bond strength of concrete to steel bars or rods. Also, the body section of the present plate is thinner then the rods of prior plates, resulting in greater concrete cover above and below the plate, again resulting in enhanced anchorage.

While a preferred embodiment of the invention has been described using specific terms, such description is for illustrative purposes only, and it is to be understood that changes and variations may be made without departing from the spirit or scope of the following claims.

What is claimed is:

1. A concrete structural element for attachment to an adjacent surface, the concrete structural element comprising:

a concrete slab having a pair of opposing planar faces being generally parallel to one another and at least one attachment side edge, at least a portion of the length of said side edge defining an acute angle with respect to one of said planar faces;

at least one side well plate partially embedded in said concrete slab, said weld plate comprising a generally planar body section disposed generally parallel between said opposing planar faces of said slab, said body section defining at least one opening therein with said concrete slab located totally around at least three sides of said body section, and a flange section integral with and adjacent an outer edge of said body section, said flange section extending upwardly from said body section generally at said acute angle relative to said body section, an inner surface of said flange section extending upwardly at said acute angle in substantially continuous contact with said side edge of said concrete slab, and an outer surface opposite said inner surface extending upwardly at said acute angle for being at least partially exposed for attachment to an adjacent surface, whereby when said side weld plate of the concrete structural element is positioned adjacent a surface to be attached to said concrete structural element, a generally V-shaped space is defined therebetween for receipt of an element therein for welding thereto.

2. The concrete structural element as defined in claim 1, wherein said weld plate is steel, and is suitable for being welded to said adjacent surface.

3. The concrete structural element as defined in claim 1, wherein said opening is rectangular in shape.

4. The concrete structural element as defined in claim 1, wherein said angle is in a range of from about 20 to about 35 degrees with respect to a plane perpendicular to said body section.

5. A concrete structural element as defined in claim 1, wherein said body section of said side weld plate is substantially rectangular in shape.

6. A concrete structural element as defined in claim 1, wherein said flange section of said side weld plate is substantially rectangular in shape.

7. A concrete structural element as defined in claim 1, wherein said opening in said body section of said side weld plate is rectangular and is totally surrounded by said body section.

8. A concrete structural element as defined in claim 7, wherein said body section of said side weld plate defines further smaller openings located around said rectangular opening.

9. A concrete structural element as defined in claim 1, wherein said flange section of said side weld plate is generally planar and smaller than said generally planar body section.

10. A concrete structural element as defined in claim 6, wherein said generally planar body section of said side weld plate is elongated and the length thereof from said outer edge adjacent said integral flange section to a side edge thereof opposite said flange section is greater than the thickness of said concrete slab.

* * * * *